US009149732B2

(12) United States Patent
Konneker

(10) Patent No.: US 9,149,732 B2
(45) Date of Patent: Oct. 6, 2015

(54) SELF-CONTAINED SOLAR POWERED MOBILE ART

(71) Applicant: Lloyd Kent Konneker, Raleigh, NC (US)

(72) Inventor: Lloyd Kent Konneker, Raleigh, NC (US)

( * ) Notice: Subject to any disclaimer, the term of this patent is extended or adjusted under 35 U.S.C. 154(b) by 95 days.

(21) Appl. No.: 13/932,861

(22) Filed: Jul. 1, 2013

(65) Prior Publication Data

US 2014/0011426 A1 Jan. 9, 2014

Related U.S. Application Data

(60) Provisional application No. 61/668,728, filed on Jul. 6, 2012.

(51) Int. Cl.

| | |
|---|---|
| ***A63H 33/00*** | (2006.01) |
| ***A63H 29/22*** | (2006.01) |
| ***A63H 33/40*** | (2006.01) |

(52) U.S. Cl.
CPC ..... *A63H 33/00* (2013.01); *A63H 29/22* (2013.01); *A63H 33/006* (2013.01); *A63H 33/40* (2013.01)

(58) Field of Classification Search
USPC ..... 446/236
See application file for complete search history.

(56) References Cited

U.S. PATENT DOCUMENTS

| | | | | |
|---|---|---|---|---|
| 6,906,254 | B2 * | 6/2005 | Reed | 446/227 |
| 2004/0070369 | A1 * | 4/2004 | Sakakibara | 320/128 |

* cited by examiner

*Primary Examiner* — Michael Dennis

(57) ABSTRACT

A mobile or stabile has rotatable elements comprising a solar cell, a beam, and an electric motor. The solar cell is electrically connected to the electric motor in the same rotatable element. The rotatable elements are linked by attaching the rotating shaft of the electric motor of one rotatable element to the beam of the rotatable element above. Each rotatable element produces its own movement. When a solar cell receives light it powers the connected electric motor to rotate its rotatable element.

3 Claims, 3 Drawing Sheets

SELF-CONTAINED SOLAR POWERED MOBILE ART

This application claims the benefit of provisional application U.S. 61/668,728 filed Jul. 6, 2012.

TECHNICAL FIELD

The present invention relates to kinetic sculptures comprising recursive assemblages of balanced, rotating beams that entertain viewers, such as mobiles and stabiles by artist Alexander Calder, and specifically to solar powered mobiles. Mobiles and stabiles are similar but mobiles are suspended from above and stabiles supported from below.

BACKGROUND

Mobiles are often driven by external wind currents, but also by external or internal motors.

Mobiles often have the property of recursive or fractal self-similarity: a sub assembly may have a similar structure as the larger assembly it is a part of.

Each element acts as a beam suspended at a balance point in the middle, with one or more recursive elements suspended from the beam. The balance point of an element balances the gravitational mass of all the elements recursively suspended below it. Most mobiles have further recursive elements suspended from one or more ends of the beam. A simple counterweight at one end of a beam may terminate recursion. Some mobiles have further recursive elements suspended from the balance point of a beam, so that the balance points are one above the other in a vertical line.

Mobiles often have elements that rotate or pivot in horizontal planes but elements also may rock or seesaw in vertical planes.

A mobile may have flat, 2D elements that may be rotated so that the entire assembly lies flat in a vertical plane, but mobiles may also have 3D elements that are balanced plates instead of beams.

Mobiles and stabiles may be connected so that relative motion between elements is limited to one or more axis and is limited in range. For example mobiles may be connected by swivels that do not limit rotation or by hangers that do limit rotation. The connection between elements may be a bearing, a swivel, a knife-edge, a hook and eye, or other pivot.

In most mobiles, elements do not normally collide but may collide when driven to extremes.

In a mobile, the weight borne by the pivot of the topmost element is the weight of the entire assemblage, whereas the weight borne by the pivot of the bottommost element is only the weight of the bottommost element. Also, the inertial mass rotated by the pivot of the topmost element is the inertial mass of the entire assemblage, whereas the inertial mass rotated by the bottommost pivot is only the inertial mass of the bottommost element. Hence, it is desirable to eliminate extraneous mass, especially in the lower rotatable elements.

Mobiles must have low mass and low friction bearings, especially indoors where wind currents have little force. Mobiles driven by solar cells also must have low mass and low friction bearings, especially indoors under artificial light which has low power.

In an economic design of a mobile, same parts are used throughout, to lower costs by price breaks for mass purchases. Eliminating parts and lessening weight furthers this goal since then all pivots can have the same starting torque ratings and still rotate their loads.

A well-designed, motor driven mobile governs the speed of rotation lest rotatable elements collide with each other or disintegrate by centripetal force. One solution to is to use small motors with reduction gearing, however that adds weight to a mobile.

Solar cell driven mobiles often have solar cells mounted in the base driving a motor in the base. This solution keeps the mass of the solar cells and motors out of the rotating elements but requires complicated mechanical or electrical transmission means to power many rotatable elements.

U.S. Pat. No. 6,906,254 teaches a mobile where each rotatable element is self-contained and capable of producing its own movement. Each rotatable element has a solar cell for power and a motivator for causing movement, for example an electric motor with a propeller. In U.S. Pat. No. 6,906,254, the solar cell is on one end of a beam, and the motivator on the other end. A swivel at the balance point of the beam attaches the beam to other similar rotatable elements. U.S. Pat. No. 6,906,254 teaches that self-contained rotatable element have the advantage of simplicity by eliminating electrical or mechanical transmission between rotatable elements. U.S. Pat. No. 6,906,254 has the disadvantage that it requires a separate swivel and a heavy aerodynamic propulsion device such as a propeller, on each rotatable element. The present invention has fewer parts and is lighter by eliminating the swivel and propeller. In the present invention, the bearing of the motor serves double duty as a swivel between rotatable elements.

Daniel Chadwick "solar kinetic mobile" http://www.youtube.com/watch?v=CADgwsEbOUU discloses a similar mobile, also having self-contained rotatable elements each having a solar cell and a propeller driven by an electric motor. However in Chadwick's mobile, the motor driven propeller is located at the balance point of the beam of the rotatable element. Such an arrangement produces a different motion than U.S. Pat. No. 6,906,254. Chadwick's mobile also has a swivel at the balance point of the beams, attaching the beam of one rotatable element to another. Chadwick's mobile has the same disadvantages as U.S. Pat. No. 6,906,254.

Daniel Chadwick discloses another "solar kinetic mobile" http://www.youtube.com/watch?v=xXTt-h2xz o having the rotating shaft of the electric motor of each rotatable element driving a reduction gear which then drives the next rotatable element. The rotation axis of all rotatable elements are substantially on the same axis. The mobile is suspended from a bearing collar in the middle of said axis. Said axis is essentially horizontal and the planes of rotations of the rotatable elements are substantially vertical. The arms of the solar cells about the axis of rotation are short. Said mobile has the disadvantage that heavy reduction gears are required to limit the speed of the rotatable elements and to overcome the friction of bearings under large bending moments. In the present invention, gearing is not required since the moment of inertia and aerodynamic drag of the solar cells and beam on long arms from the axis of rotation serves to govern the speed of rotation. The present invention also has the advantage that the bearings of the electric motors carry axial gravity loads and have no friction due to bending moments, allowing movement under low power. Chadwick's mobile elements are arranged iteratively (not recursively) on the same axis. The present invention also has the advantage that a mobile element is recursively supported asymmetrically offset from the prior mobile element.

Cerrito and Farinha disclose a "solar chandelier" http://prntscreen.net/thisblog/selected-works/solar-chandelier also having rotatable elements, each having a solar cell and an electric motor. In Cerrito and Farinha's mobile each motor is located at the balance point of a rotatable element and directly rotates the rotatable element below. In Cerrito and Farinha's mobile each motor's bearing serves double duty as a swivel between rotatable elements.

In Cerrito and Farinha's mobile the rotating electric motor shaft is directed downward and connected to the sub assembly below. The electric motor of one rotatable element rotates the sub assembly below. Thus light to the solar cell of one rotatable element does not move said solar cell (and change the light it receives) but only moves the solar cells in rotatable elements below. This has the disadvantage that a rotatable element can not move itself. The present invention has the advantage that a rotatable element can move itself without receiving power or control from another rotatable element.

In Cerrito and Farinha's mobile, rotatable elements are suspended one to another by torsionally rigid hangers, comprising a short beam centered on the shaft of an electric motor having four flexible lines connected from each corner of the short beam to the beam of the connected rotatable element. A hanger does not allow a rotatable element to move itself, even via reactive (equal and opposite torque) effects in the opposite direction of rotation as the electric motor is driving the rotatable element below. A rotatable element is prevented from rotating due to reactive torque of its own motor by the rotatable element's torsionally rigid hanger to the rotatable element above.

If rotatable elements are suspended one to another by a torsionally flexible hanger between one element and the shaft of the motor of another element, when the motor starts the reactive torque effect may wind up the torsionally flexible hanger like a rubber band. The torsionally flexible hanger may wind up until it becomes torsionally stiff, stopping the motor's rotation, then unwinding against the stopped motor, driving continued relative rotation of the connected rotatable elements. This may produce an undesirable, jerky motion of the mobile. Yet a torsionally flexible coupling requires less starting torque from the motor. A torsionally flexible coupling, for intermittent driving of the motor, may also produce a smooth, damped, oscillating motion that continues after cessation of motor driving.

The arrangement in Cerrito and Farinha's mobile, results in a particular pattern of motion of the mobile, described as "fighting" since one rotatable element rigidly moves another. The fighting pattern of motion may not be pleasing to viewers.

Cerrito and Farinha's mobile includes control elements whereby a first rotatable element controls a second rotatable element above, so the first rotatable element can command the second rotatable element to move the first. This has the disadvantage of extra weight for control elements.

In Cerrito and Farinha's mobile each rotatable element is not fully self-contained since to move itself, control signals need to be sent from one rotatable element to the element above. This has the disadvantage that when wires are used to transmit control signals, the wires may become twisted by the rotation of rotatable elements.

Cerrito and Farinha's mobile has the disadvantage that each rotatable element does not have an identical configuration: the bottommost rotatable element needs no motor. The present invention has the advantage that the bottommost rotatable element has a motor like the other rotatable elements.

Cerrito and Farinha's mobile also has the disadvantage that rotatable elements are suspended one to another by axially flexible hangers. Such an arrangement requires careful design and fabrication to keep each sub assembly balanced and aligned so that rotatable elements do not collide with each other.

There are numerous solar helicopter toys for sale, where a symmetrical, self-contained rotor element includes a solar panel and a motor and the rotating element of the motor is attached to the body of the helicopter. The present invention has the advantage that an asymmetrical, self-contained mobile element is recursively supported asymmetrically offset from the prior mobile element.

SUMMARY

One object of the invention is to minimize the part count of a mobile, to simplify manufacture and increase reliability.

Another object is to minimize the size and weight of a mobile, to allow movement even in low-light or low wind currents.

Another object is low part count, part size, and weight so that a mobile can be made small to fit in confined spaces, for example on a window sill.

Another object is a mobile where each rotatable element is self-contained, self-propelled, and self-governing so that no power transmission or control communication is required between rotatable elements.

Another object is a mobile where each rotatable element is identical except for the point of attachment between two rotatable elements, for simplicity of manufacture.

Accordingly, in the present invention rotatable elements comprise a solar cell, a beam, and an electric motor electrically connected to the solar cell. The case of each electric motor is fixed to its beam so that the rotating shaft of the electric motor is directed substantially upward toward the rotatable element above. The rotating shaft of each electric motor is attached to the beam of the rotatable element above so that the rotatable elements rotate with respect to each other about the axis of the rotating shaft via the bearing of the electric motor.

The rotatable elements can be configured to construct mobiles of varying types. A traditional, balanced, recursive type of mobile can be configured by positioning the electric motor of each rotatable element on its beam at the balance point for the sub assembly for which said rotatable element is the topmost, and by attaching the rotating shaft of each electric motor to the rotatable element above by an axially flexible hanger.

An alternative mobile configuration has the rotating shaft of each electric motor rigidly attached to the beam of the rotatable element above such that the planes of rotation of the rotating shafts are not parallel to the beam of the rotating element above.

DESCRIPTION OF EMBODIMENTS

Figure 1:
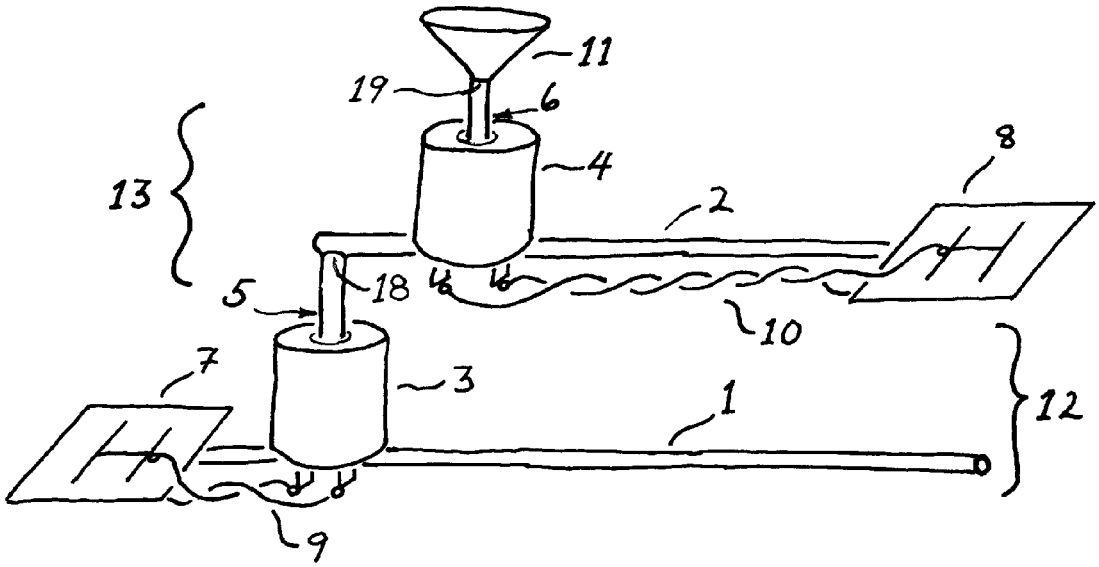
FIG. 1 shows an isometric view of an embodiment of the invention arranged as a traditional, balanced mobile.

FIG. 1 shows first and second rotatable elements 12 and 13 comprising beams 1 and 2, powered electric motor cases 3 and 4, rotating electric motor shafts 5 and 6, solar cells 7 and 8, wire pairs 9 and 10, and base 11.

On the first rotatable element 12, solar cell 7 and powered electric motor case 3 are fixed to beam 1. Wire pair 9 connects and delivers electrical power from solar cell 7 to powered electric motor case 3. Said electric power propels powered electric motor case 3 to rotate about rotating electric motor shaft 5, thereby also rotating beam 1 and solar cell 7. Working end 18 of rotating electric motor shaft 5 is attached to beam 2 of the second rotatable element 13.

The second rotatable element 13 has a similar configuration as the first rotatable element 12. The working end 19 of rotating electric motor shaft 6 of the second rotatable element is attached to base 11. Electrical power from solar cell 8 propels powered electric motor case 4 to rotate about rotating electric motor shaft 6, thereby also rotating the entire assemblage of first 12 and second 13 rotatable elements about base 11.

In the embodiment of FIG. 1, powered electric motor case 3 is positioned on beam 1 at a point that balances the weight of components to each side. Similarly, powered electric motor case 4 is positioned on beam 2, such that the center of gravity of the entire assemblage is orthogonally below powered electric motor case 4. The powered electric motor case 4 is fixed orthogonally to beam 2. The working end 19 of rotating electric motor shaft 6 is attached aligned vertically to base 11. By such means, the bearings of the electric motors (e.g. between rotated electric motor case 4 and rotating electric motor shaft 6) receive mainly axial gravity loads, and the rotating electric motor shafts 5 and 6 receive mainly tensile gravity loads.

In the embodiment of FIG. 1, working ends 19 and 18 of rotating electric motor shafts 5 and 6 may be attached rigidly to base 11 and beam 2. My such means, the rotatable elements are mechanically prevented from collisions, except by extreme bending of their beams.

In the embodiment of FIG. 1, working ends 19 and 18 of rotating electric motor shafts 5 and 6 may be attached by torsionally rigid but axially flexible hangers to base 11 and beam 2. For example, a simple hook and eye may be used. By such means, the rotatable elements may gently rock up and down. The use of hangers having some torsional flexibility, such as a hook and eye or a nylon cord, is advantageous since such hangers may have lower torsional friction than the electric motor bearings, allowing the electric motors to start under low power.

Note that the present invention encompasses both mobiles (suspended from above) and stabiles (supported from below.) As a stabile, the shafts of the electric motor must be semi-rigidly attached to the beam or base below, for example by attachments 18 and 19 comprising rubber blocks.

In the embodiment of FIG. 1, the rotating electric motor shafts 5 and 6 are parallel but not on the same line. Such an arrangement results in a pleasing variety of motions.

Figure 2:
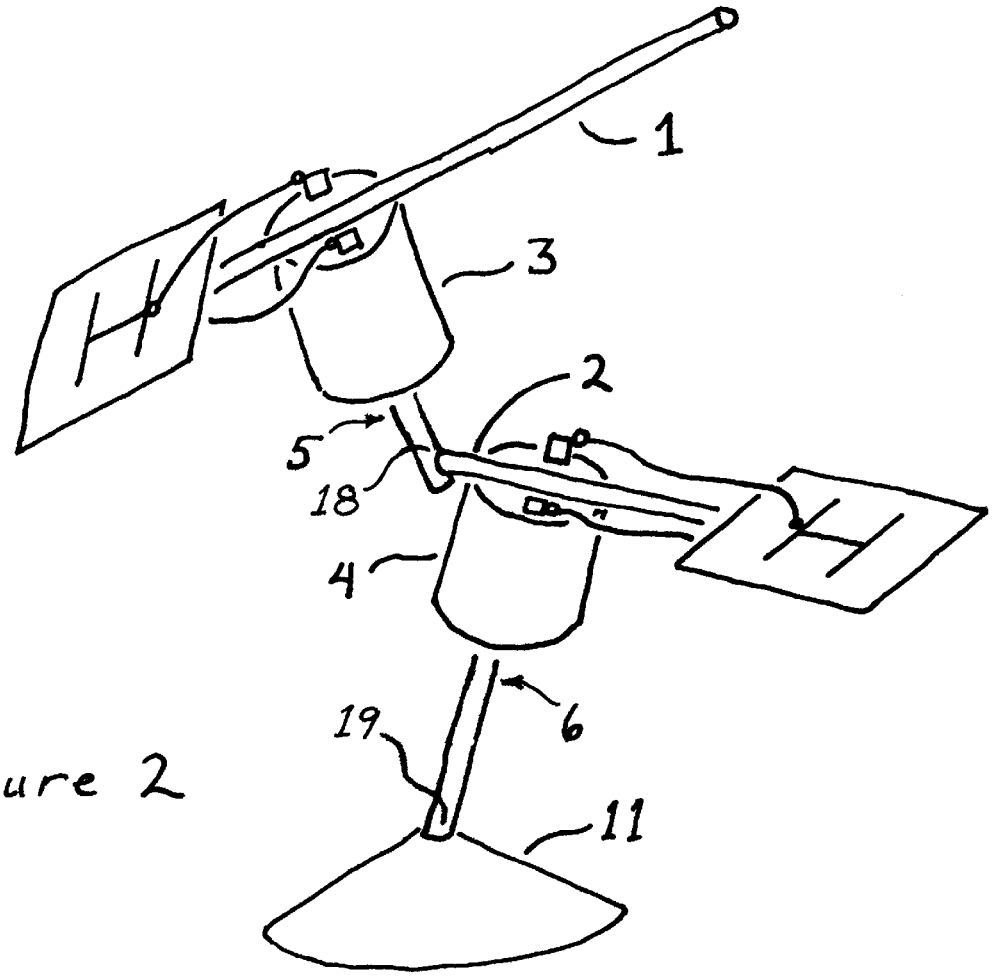
FIG. 2 shows an isometric view of an embodiment of the invention where the assemblage and assembled sub elements are not balanced, in a stabile.

FIG. 2 shows another embodiment, a stabile, where the powered electric motor cases 3 and 4 are not positioned on beams 1 and 2 at their balance points and where rotating electric motor shafts 5 and 6 are fixed neither orthogonal to beam 2 and base 11, nor aligned vertically on the same line, but fixed at an angle. In this embodiment, the bearings of the electric motors receive non-axial gravity loads and the rotating electric motor shafts 5 and 6 receive non-tensile gravity loads (bending moments.) This embodiment may also be a mobile. In a mobile, any combination of balanced and unbalanced rotatable elements may be used.

In another embodiment the rotating electric motor shafts 5 and 6 are parallel and on the same vertical axis. In this embodiment, one solar cell 7 may be shaded by the other solar cell, resulting in a pleasing synchrony of motion between the first and second rotatable elements. In this embodiment, first and second rotatable elements may be identical, whereas in the embodiment of FIG. 1, the first and second rotatable elements have different configurations so as to be balanced.

Note that in this invention, several rotatable elements can use electric motors having the same class having starting torque ratings that still rotate their loads.

In the embodiment of FIG. 1, the electric motors can be brushed DC motors where the powered electric motor cases 3 and 4 each have terminals connected to commutating brushes and the rotating electric motor shafts 5 and 6 each are fixed to wound armature having a commutator ring. Note that many types of electric motors may be used, for example, electronically commutated motors where the powered electric motor cases 3 and 4 each have terminals connected to field windings and where the rotating electric motor shafts 5 and 6 each are fixed to a rotating permanent magnet core. Note that many physical configurations of the electric motors may be used, for example, an electronically commutated motor having powered electric motor case 3 a field winding near the first rotatable element 12 and having rotating electric motor shaft 5 fixed to a permanent magnet core on the other side of the motor bearing, nearer the second rotatable element 13.

In the embodiment of FIG. 1, the bearings of the electric motors may be magnetic bearings. It is particularly advantageous to design the electric motors so that when energized, electromagnetic forces in the electric motor lift the axial gravity loads from the mechanical thrust bearing of the electric motor. By such means, friction in the thrust bearing of the electric motor may be reduced, allowing a rotatable element to start at low power.

Figure 3:
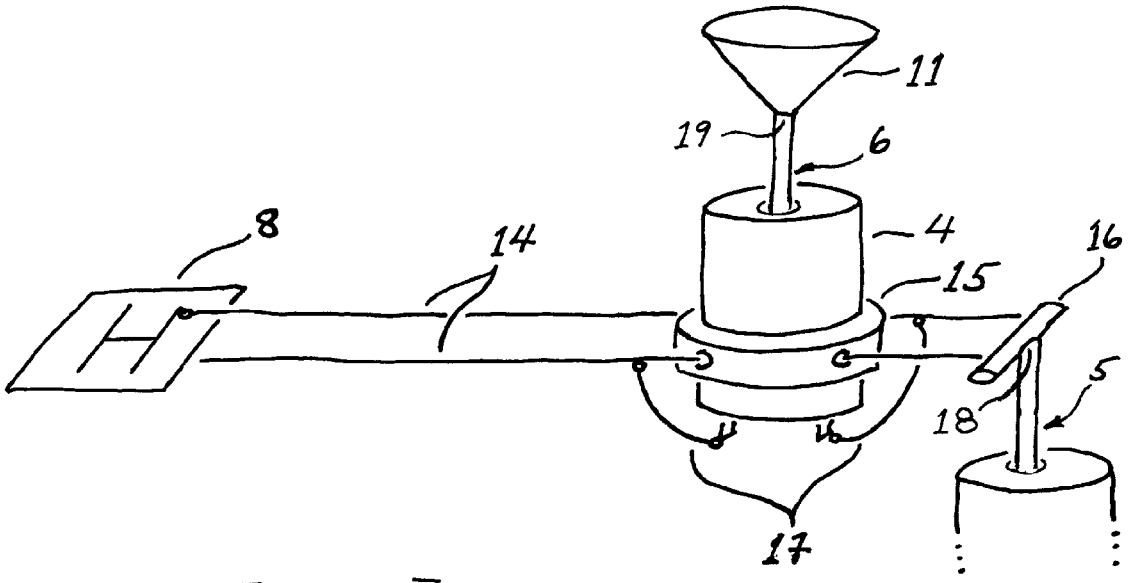
FIG. 3 shows an isometric view of one rotatable element of an embodiment where the beam of the rotatable element comprises two parallel conductive elements and delivers power from a solar cell to a powered electric motor on the same rotatable element.

FIG. 3 shows an embodiment where the beam itself comprises two parallel conductive beams 14 which deliver power from solar cell 8 to powered electric motor case 4. Parallel conductive beams 14 may be for example stiff steel wire. Insulative element 15 insulates conductive beams 14 from electric motor case 4. One of conductive beams 14 is soldered to the bottom terminal of solar cell 8 and the other conductive element 14 is soldered to the top terminal of solar cell 8 (a solar cell typically comprises a semiconductor plate with terminals on top and bottom.) Insulative element 15 insulatively attaches conductive beams 14 to powered electric motor case 4. Conductive jumper wires 17 connect each of the conductive beams 14 to a terminal of powered electric motor case 4. Insulative element 16 maintains insulative separation of conductive beams 14 and supports the sub assembly below. The working end 18 of rotating electric motor shaft 5 of the sub assembly below is attached to insulative element 16. This embodiment advantageously saves the weight of wire pairs 9 and 10 of FIG. 1.

Insulative element 15 may be a collar, as shown, and may simply be sections of rubber tubing. Alternatively, conductive beams 14 may be soldered to the terminals of electric motor case 4, foregoing jumper wires 17, when said terminals are structural and positioned on opposite sides of the motor's axis. Alternatively, conductive beams 14 may be attached to electric motor case 4 when it is insulative.

In the embodiment of FIG. 3, conductive beams 14 are in a horizontal plane. In another embodiment, conductive elements 14 may be arranged in a vertical plane to form a truss beam, the top conductive beam in tension and the bottom conductive beam in compression.

In the embodiment of FIG. 1 there is no electrical storage or control elements. In another embodiment, electrical storage elements such as capacitors or batteries may be included in rotatable elements. Such storage elements may be artfully arranged to balance the assembly. Such storage devices may provide uninterrupted motion even when a light source is interrupted.

In another embodiment electronic control devices may be included in rotatable elements. Such electronic control devices may include sensors, timers, switches, actuators, and other control elements. For example, such control devices may sense voltage and current from the solar cell and switch said current. For example, such control devices may sense ambient light and switch said current to a storage device under low light conditions until, when high light conditions return or the storage is full, said current is switched to the electric motor. Such a control strategy may provide intermittent motion under low light conditions such as indoors under artificial light. Such control devices may provide more pleasing patterns of motion. Such control devices may detect and prevent or encourage synchronous motion between rotatable elements, or conditions of non-movement, for example when one solar cell is shading another. Note that each rotatable element may have self contained electrical storage and control elements.

In another embodiment electronic control devices may include wireless electromagnetic communication devices for communication between control devices of different rotatable elements, or between rotatable elements and the base or remote controls.

Note that in the present invention, two rotatable elements may rotate in different directions, one clockwise and the other counterclockwise. Such an arrangement may have advantages since the lower rotatable elements, with smaller inertial moments and under lower gravity loads, may start turning first and through reactive torque effects assist the starting of rotatable elements above.

Note that in the present invention the solar cells may be in any orientation. Orienting solar cells with their plane horizontal may be most generally advantageous under daily and seasonal sunlight variations. Orienting solar cells with their plane more vertical may give pleasing patterns of movement for example, that coincide with the low azimuth sunlight of morning and evening. Orienting solar cells with their plane more vertical may increase their aerodynamic drag to govern speed of rotation.

Note that the present invention can also use wind currents, as in traditional mobiles, by including aerodynamic elements or by the orientation of solar cells to serve double duty as aerodynamic elements. When there is no light, the electric motors offer some resistance to wind driven rotation, so torsionally flexible support may be used.

Note that the present invention may also use shade elements, either on rotatable elements or attached to the base, to provide varying patterns of motion as a shade element shades a solar cell.

The invention claimed is:

1. A mobile having a base and at least one rotatable element, each at least one rotatable element comprising:

a beam having first and second ends and a center of gravity;

a solar panel for producing electricity in light, the solar panel attached near the first end of the beam;

an electric motor connected to the solar panel for receiving the produced electricity, comprising a case having electrical connection and a driven, rotating shaft having a working end, the motor's case attached to the beam at or near the center of gravity, so that a rotational force produced by the motor is about an axis substantially perpendicular to the beam at the beam's center of gravity;

a balancing object supported by the second end of the beam for balancing the beam so that the center of gravity is located between the ends of the beam, where the balancing object may recursively be another rotatable element;

and wherein the working end of the rotating shaft of the electric motor of a first at least one rotatable element is attached to the base, and the working end of the rotating shaft of the electric motor of any second at least one rotatable element is attached to the second end of the beam of said first at least one rotatable element.

2. A mobile according to claim 1, wherein the working end of the rotating shaft of the electric motor of a first at least one rotatable element is flexibly attached to the base so that the rotating shaft can torque relative to the base, and the working end of the rotating shaft of the electric motor of any second at least one rotatable element is flexibly attached to the second end of the beam of said first at least one rotatable element so that the rotating shaft can torque relative to the beam of said first at least one rotatable element.

3. A mobile according to claim 1, wherein the beam of the first at least one rotatable element comprise two substantially parallel, electrically conductive beams, the first conductive beam connecting the positive terminal of the solar panel of the first at least one rotatable element to the positive terminal of the electric motor of the first at least one rotatable element and the second conductive beam connecting the negative terminal of the solar panel of the first at least one rotatable element to the negative terminal of the electric motor of the first at least one rotatable element, so that the conductive beams conduct produced electricity from the solar panel to the electric motor and provide structure.

* * * * *